US005971041A

United States Patent [19]

Drewitz

[11] Patent Number: 5,971,041

[45] Date of Patent: Oct. 26, 1999

[54] CONTAINER FILLING APPARATUS WITH WALKING NOZZLES BANK

[75] Inventor: Hugues Drewitz, St-Eustache, Canada

[73] Assignee: Kalish Canada Inc., Canada

[21] Appl. No.: 09/102,692

[22] Filed: Jun. 22, 1998

[51] Int. Cl.[6] ..... B65B 43/42

[52] U.S. Cl. ..... 141/135; 141/137; 141/165; 141/180; 141/269; 141/270; 141/372

[58] Field of Search ..... 141/135, 137, 141/165, 177, 180, 181, 183, 187, 188, 94, 263, 269, 270, 279, 283, 284, 372, 168, 169, 171, 172, 176, 156

[56] References Cited

U.S. PATENT DOCUMENTS

| | | | |
|---|---|---|---|
| Re. 29,482 | 11/1977 | Rosen . | |
| 707,994 | 8/1902 | Warren | 141/147 |
| 1,442,405 | 1/1923 | Hawthorne | 141/156 |
| 1,892,627 | 12/1932 | Pearson . | |
| 1,977,138 | 10/1934 | Newey . | |
| 1,992,464 | 2/1935 | Blackman | 141/57 |
| 2,367,387 | 1/1945 | Davies . | |
| 2,581,795 | 1/1952 | Howard . | |
| 2,699,282 | 1/1955 | Day et al. . | |
| 3,020,939 | 2/1962 | Donofrio . | |
| 3,100,513 | 8/1963 | Cozzoli et al. | 141/102 |
| 4,004,620 | 1/1977 | Rosen . | |
| 4,073,322 | 2/1978 | Bennett . | |
| 4,789,016 | 12/1988 | Mihail . | |
| 5,595,221 | 1/1997 | Lagneau | 141/177 |

*Primary Examiner*—Steven O. Douglas
*Assistant Examiner*—Peter deVore
*Attorney, Agent, or Firm*—Ratner & Prestia

[57] ABSTRACT

A machine for filling fluid product into containers delivered in a row by a conveyor has a filling station with a walking nozzle bank. Containers are processed batchwise through the filling station, the nozzle bank including elongated gripper plates that are moved laterally to engage the containers while the nozzles are inserted therein. Once a batch of containers has been received in the filling station and engaged by the gripper plates, the container batch is allowed to move in the conveying direction together with the nozzle bank as the containers are being filled. Movement of the containers is controlled without the need for feed screws.

12 Claims, 8 Drawing Sheets

CONTAINER FILLING APPARATUS WITH WALKING NOZZLES BANK

This invention relates to a new or improved filling apparatus for filling fluid products into containers in an automated manner. The invention is particularly concerned with a filling apparatus of the so-called "walking nozzles" type, i.e. one of which the containers are moved along a path by a conveyor, and filling is effected by a bank of nozzles which move with the containers as filling proceeds.

There are numerous examples of container filling machines in the prior art, many of which include so-called "walking nozzles". For example U.S. Pat. No. 4,004,620 Rosen shows a fluid filling machine in which the filling nozzles are carried on a support structure that is actuated to reciprocate in the direction of movement of the containers while these are being filled, and to move opposite to this direction after the nozzles are raised clear of the tops of the containers. In Rosen movement of the containers along the conveyor is controlled by use of a feed screw that engages and advances the containers as this screw rotates. However feed screws are fairly complex pieces of equipment since they require timing gears and drive motors and they are a dedicated change part that has to be replaced every time a new container size is utilized, making the conversion to a different container size more difficult.

OBJECT OF THE INVENTION

It is the object of the present invention to provide a container filling apparatus of the walking nozzles type which does not require a feed screw to advance the containers through the filling station. In the present invention, movement of the containers is controlled by a conveyor. The fact that the containers are touching each other allows the speed of the conveyor to be reduced significantly compared with the feed screw system normally used in this type of filling station. The speed is reduced because every container has to travel a distance equivalent to its diameter or length without having to add to this distance, the gap between two containers which is normally equivalent to one container's diameter or length when using a feed screw mechanism. This results in a traveling speed which is half the speed of existing systems for the same output. This reduced speed results in a much smoother operation, particularly appreciated in liquid filling lines because it practically eliminates all splashing problems often encountered in existing system.

Another advantage of this invention is that it allows the operator to run the filling station in a "fix mode" or a "walking mode". The fix mode can be used when filling large containers where the cycle time saved by having the nozzles to travel with the containers is insignificant; The filling time being much longer than the gating time.

SUMMARY OF THE INVENTION

The present invention provides A filling apparatus for filling a product into containers, comprising: a filling station adapted to receive containers coming from a conveyor system and to separate the containers into batches, said filling station capable of simultaneously filling the product into the containers of each batch, and also adapted for discharging batches of filled containers from an exit end of said station for further processing; wherein said filling station comprises: a walking nozzle bank having a series of nozzles mounted to move in unison to be inserted into respective ones of the containers of each batch to add product thereto, and to be withdrawn from said containers when filling has been completed; a transport system for advancing said nozzle bank in a longitudinal direction towards said exit end in synchronized movement with and during filling of the batch of containers; and a gripper mounted for movement in a longitudinal direction in synchronism with said walking nozzle bank, said gripper being selectively operable to engage the containers of each batch received into said filling station, to securely hold the batch of containers during nozzle insertion, filling and nozzle retraction, and after filling has been completed to release the batch of containers for discharge from said exit end.

The gripper preferably comprises a pair of opposed jaws which extend in the longitudinal direction of the conveyor system and which have rows of registering recesses arranged in opposed pairs each pair being adapted to engage and securely grip a respective container, the jaws being movable in a transverse direction to grip or release the containers as required. The containers are transported on a conveyor that passes through the filling station and beyond the exit end thereof, there being a gate at the entrance to the filling station, the gate being operable either to prevent transfer of containers on the conveyor into the filling station, or to permit entry of a predetermined number of containers constituting a batch, there being a second gate mounted to move in unison with said gripper and said walking nozzle bank in order to hold the first container of each batch received into said filling station, and there being a blocker in the filling station which is operable when required to prevent movement of the containers from the exit end. The top of the conveyor is smooth so that it can slide freely under the containers when the latter are immobilized or retarded by the gates or the blocker.

For tall or unstable containers, a series of relatively wide and stable cups supported on the conveyor are provided, each cup to receive a container.

The nozzles are preferably mounted on a beam that is reciprocated in a longitudinal direction e.g. by a pneumatic cylinder. Likewise the nozzle bank is mounted to reciprocate in the vertical direction so that the nozzles can be lowered into the containers for filling and thereafter raised and withdrawn.

The invention will further be described, by way of example only, with reference to the embodiment illustrated in the accompanying drawings wherein.

Figure 1:
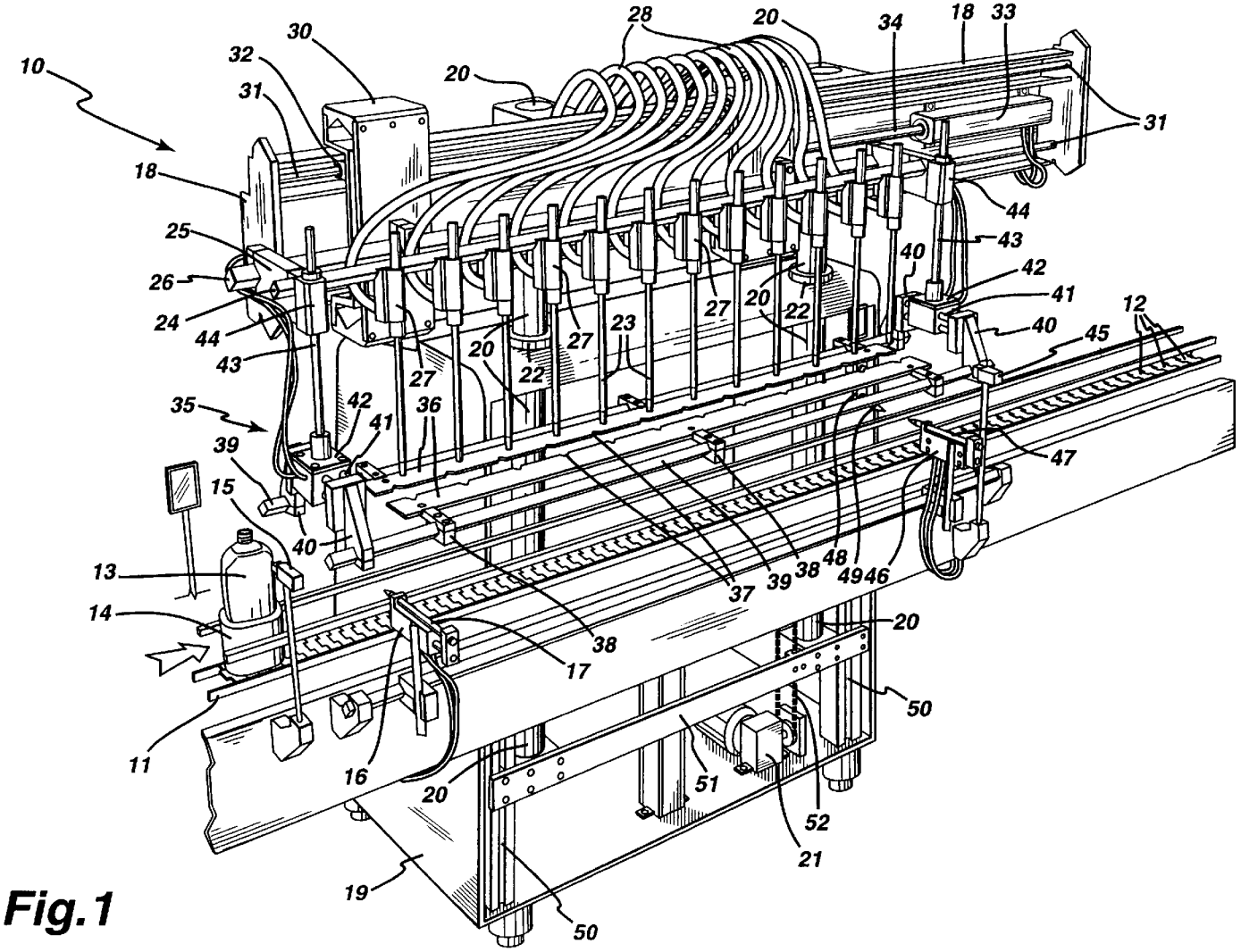
FIG. 1 is a perspective view of the filling station shown at the start of a cycle.
Figure 2:
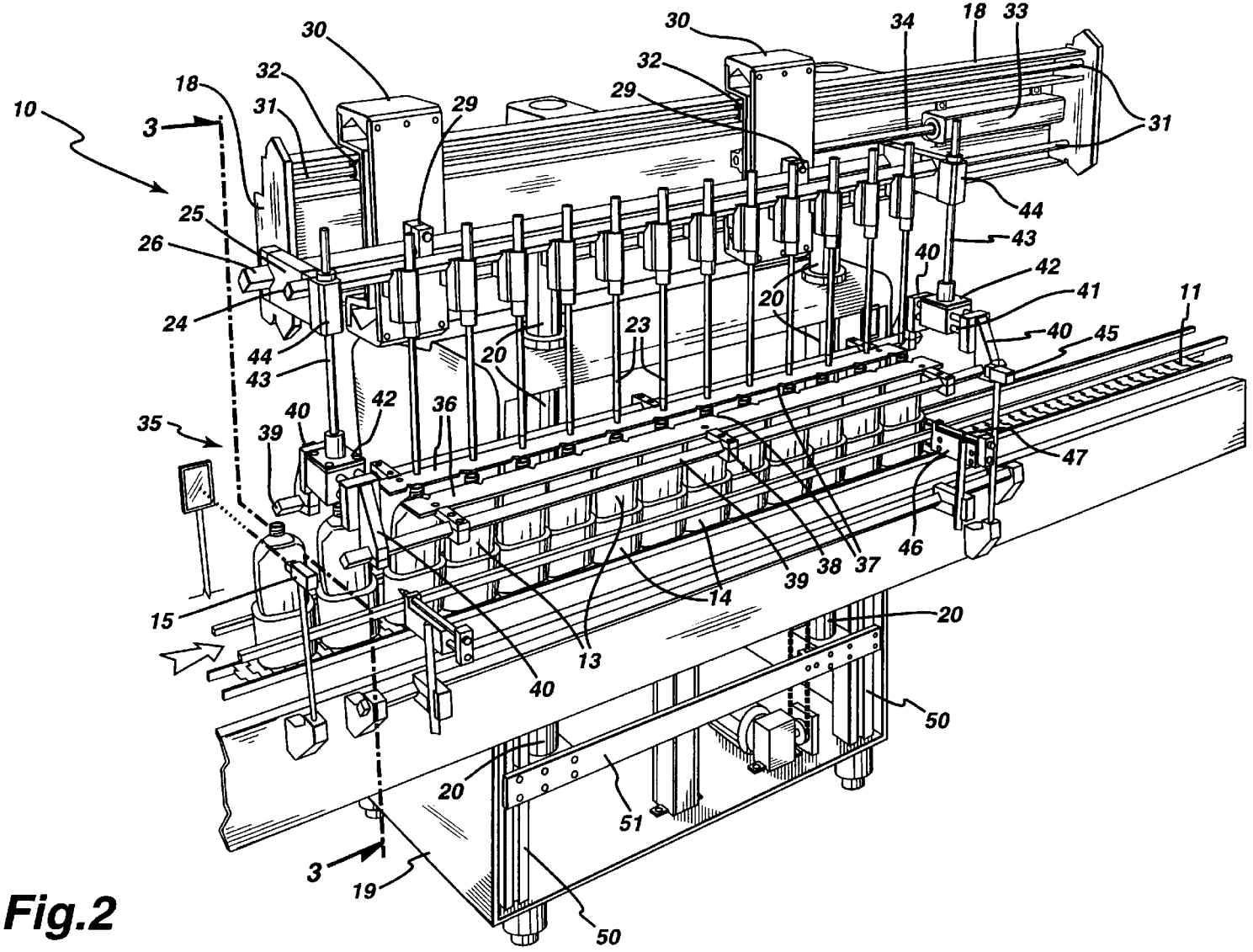
FIG. 2 is a view similar to FIG. 1 showing a later stage.

In FIG. 1 of the drawings is shown indicated by the arrow 10, the filling station of a container processing machine, the remainder of the machine being omitted since it does not form part of the present invention. As shown, the filling station 10 is traversed by a continuously moving horizontal conveyor 11 formed by flat-topped pivotally interconnected smooth metal or plastic plates 12, the conveyor moving through the filling station 10 from an entry end shown on the left to an exit end shown on the right. The station is adapted to fill a fluid product into containers that are delivered in a is row on the conveyor 11, one such container 13 being shown at the left in FIG. 1, the arrow indicating the direction in which container is carried by the conveyor. The particular container 13 shown is of a tall slender configuration, and to give it added stability it is transported in a broad based open topped cup 14 of plastic material adapted to receive the container snugly therein.

As shown in FIG. 1, upon approaching the filling station, each container 13 is moved past a counter 15, the container interrupting a beam of light for example, each such interruption being recorded electronically in a memory providing a readout of the number of containers passing the counter over a predetermined period.

At the inlet side of the filling station 10, entry of containers 13 is controlled by a start gate 16 having a pneumatically controlled piston rod 17 which can be extended to block passage of containers into the filling station, or retracted to allow such passage. The piston rod 17 is of robust construction being of sufficient strength as to restrain a series of containers delivered by the conveyor, during this restraining phase the conveyor 11 being driven continuously and its plates 12 sliding beneath the lower ends of the containers 13, or the cups 14 where the latter are provided.

The principal components of the filling station comprise a horizontal longitudinally extending main beam 18 which is actuated for vertical movement in the machine frame 19 by a pair of posts 20 which are attached rigidly to the main beam 18. The upper parts of the pair of posts 20 are held in the frame 19 by bushings 22 which guides the up and down motion of the posts 20. Inside the machine frame 19, the lower parts of the pair of posts are held rigidly in a tie bar 51 which is connected at each end to a pair of guide extrusions 50. The tie bar 51 is guided in the up and down motion by the pair of guide extrusions 50. This arrangement creates a solid structure for the movements of main beam 18. A motor 21 drives a chain 52 fastened to the tie bar 51 and raises or lowers the main beam 18.

Figure 3:
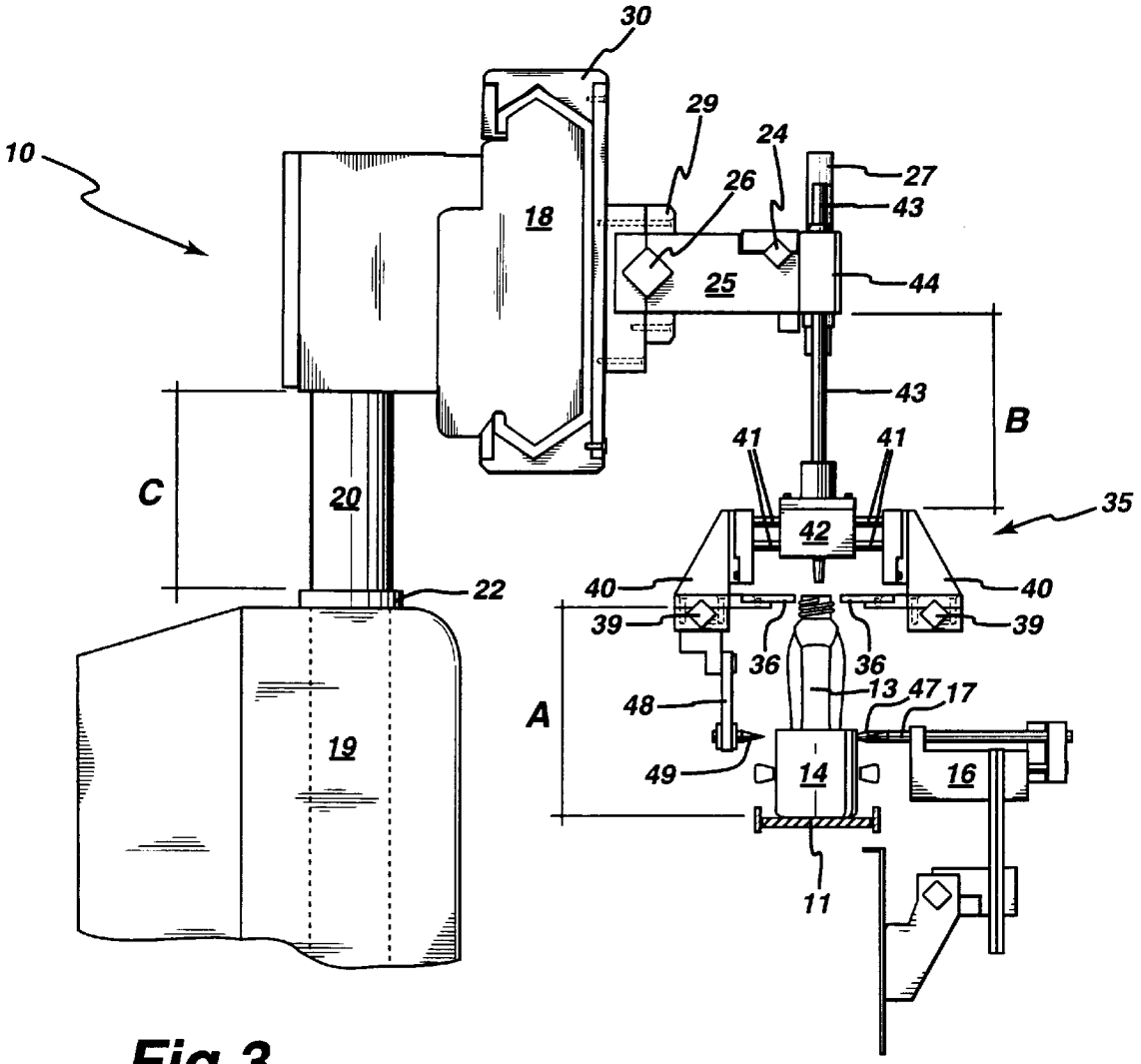
FIG. 3 is a partial sectional view taken on the line 3—3 in FIG. 2.
Figure 5:
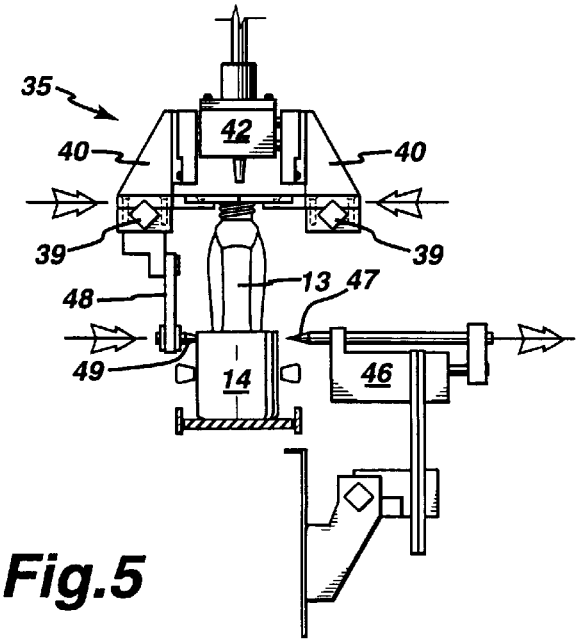
FIG. 5 is a fragmentary sectional view taken on the line 5—5 in FIG. 4.

A bank of nozzles 23 is carried on a longitudinally extending horizontal mounting bar 24 which is supported at its ends on a pair of horizontally transversely extending frame plates 25 which in turn are attached to a carrier bar 26 which extends horizontally in the longitudinal direction. In known manner, each of the nozzles 23 is carried in a mounting bracket 27, the nozzles being adjustably attached at uniform spacing along the mounting bar 24. Each nozzle is supplied with the fluid product to be dispensed from a pump (not shown) through a respective hose 28. As is best seen in FIG. 3, the mounting bar 24 and the nozzles are supported in cantilevered fashion. To better resist turning forces imposed by the weight of the components, both the mounting bar 24 and the carrier bar 26 are of square section. The carrier bar 26 is in turn attached through clamping brackets 29 to a pair of longitudinally spaced large C-shaped carriages 30 which are longitudinally spaced and which are guided for movement lengthwise of the main beam 18. The main beam 18 includes longitudinally extending cylindrical guide rods 31 which cooperate with respective upper and lower tubular bushings 32 in the carriages 30. The carriages are moveable along the beam 18 and are interconnected through the carrier bar 26 which is rigidly secured to both carriages through the clamping brackets 29 so that the carriages move as one. The bushings 32 with the guide rods 31 provide a precise linear guidance of the carriages 30 (and with them the bank of nozzles 23) in a direction parallel to the length of the conveyor. Longitudinal movement of the carriages 30 is controlled by a pneumatic piston assembly 33 mounted within the beam at one end thereof and having a projecting piston rod 34 that is connected to the right hand carriage 30, the piston rod being extensible and retractable with respect to the cylinder assembly to effect reciprocating movement of the bank of nozzles 23 in the longitudinal direction of the conveyor.

To engage and retain the containers in fixed longitudinal positions in register with respective ones of the nozzles 23 during the filling operation, the filling station also includes a gripper system generally indicated at 35 and a walking gate 48. The gripper system comprises a pair of opposed longitudinally extending jaws or clamp plates 36 defining pairs of opposed gripping notches 37 with which to engage the containers, the pairs of gripping notches being in alignment with respective ones of the nozzles 23. The gripping notches are of course configured to match the particular container being processed at any given time, and to this end the plates 36 are replaceable, being detachably mounted on spaced brackets 38 adjustably positioned on a pair of longitudinally extending mounting bars 39, the mounting bars in turn being carried in end frames 40. The walking gate 48 is fastened to the mounting bar 39, opposite end gate 46 and moves with the gripper system to hold the first container of a batch. The position of walking gate 48 is adjustable laterally on the mounting bar 39 and it has a pointed end 49 adjustable in the upright position.

Each of the end frames 40 has four rectangularly spaced guide pins 41 extending therefrom transversely to the length direction, the guide pins being received within a parallel gripper 42 containing powered actuators (not shown) such as pneumatic pistons which are operative to reciprocate the opposed pairs of end frames towards or away from the parallel gripper. Movement of the end frames 40 towards the parallel grippers 42 corresponds to movement of the clamping plates 36 towards one another to effect gripping of containers when required and to the movement of the walking gate 48 to hold the first container of a batch.

The parallel grippers 42 as shown are located beyond the nozzles 23 and each is carried in dependent fashion on a mounting rod 43 that is adjustably connected to a mounting block 44 attached to the front end of the respective frame plate 25. By means of the adjustable mounting blocks 44 and mounting rods 43, the height of the clamp plates 36 can be adjusted to correspond to their desired gripping position in the height of the containers 13. In the example illustrated, the gripping notches 37 are intended to grip the neck portion of each container in the filling station, as discussed further here below.

At the downstream or exit end of the filling station there is mounted a blocker or end gate 46 having a piston rod 47. As shown, the piston rod is oriented transversely to the conveying path in similar manner to the piston rod 17 of the start gate, but is located at the outlet end of the filling station and can be extended across the filling station to prevent passage of containers out of the filling station.

The main components of the filling station having been identified above, the operation of the filling station during a filling cycle will now be described, it being understood that the filling station is designed to handle containers batchwise, the size of a batch corresponding to the number of filling nozzles 23, and in the illustrated example being 12 containers.

In the start position as illustrated in FIG. 1, the end gate 46 is open, the piston rod 47 having been withdrawn so that containers which were previously present in the filling station have been carried away by the continuously running conveyor 11. The filling nozzles 23 lie retracted to their uppermost position (where their lower ends will be above the tops of the containers 13) and the clamp plates 36 lie separated to an extent sufficient to allow passage of the containers. As shown in FIG. 1, containers 13 supplied by the conveyor are prevented from entry into the filling station by the start gate 16, the piston rod 17 of which is extended partially across the conveyor just enough to block the path of movement of the containers 13. The function of the start gate 16 is to stop the flow of containers for a short lap of time in order to create a gap between the last container of a batch and the first container of a new batch. This gap allows the end gate 46 to extend past the last container of a batch and hold the next batch. It should be noted that if the containers 13 have a round configuration, the start gate 16 is not needed. The walking gate 48 is capable of separating the batches by inserting its pointed end 49 between the last container of a batch and the first container of a new batch.

Upon receipt of a start signal, the piston rod 17 is withdrawn so that containers 13 resting on the constantly moving conveyor 11 are now freed to move longitudinally into the filling station. The piston rod 47 of the end gate 46 is extended across the conveyor path to block progress of the containers out of the filling station, so that the first container 13 is positioned with its neck in alignment with the endmost nozzle 23, and each subsequent container 13 is aligned with a corresponding one of the nozzles. When the correct number of containers (as counted off by the counter 15) has entered the filling station, the start gate 16 is operated to extend the piston rod 17 across the conveyor to prevent entry of any further containers, and the filling cycle commences. Piston rod 17 stays extended for a short period of time, just enough to create a gap between the last container of the previous batch of containers and the first container of the next batch of containers.

Figure 4:
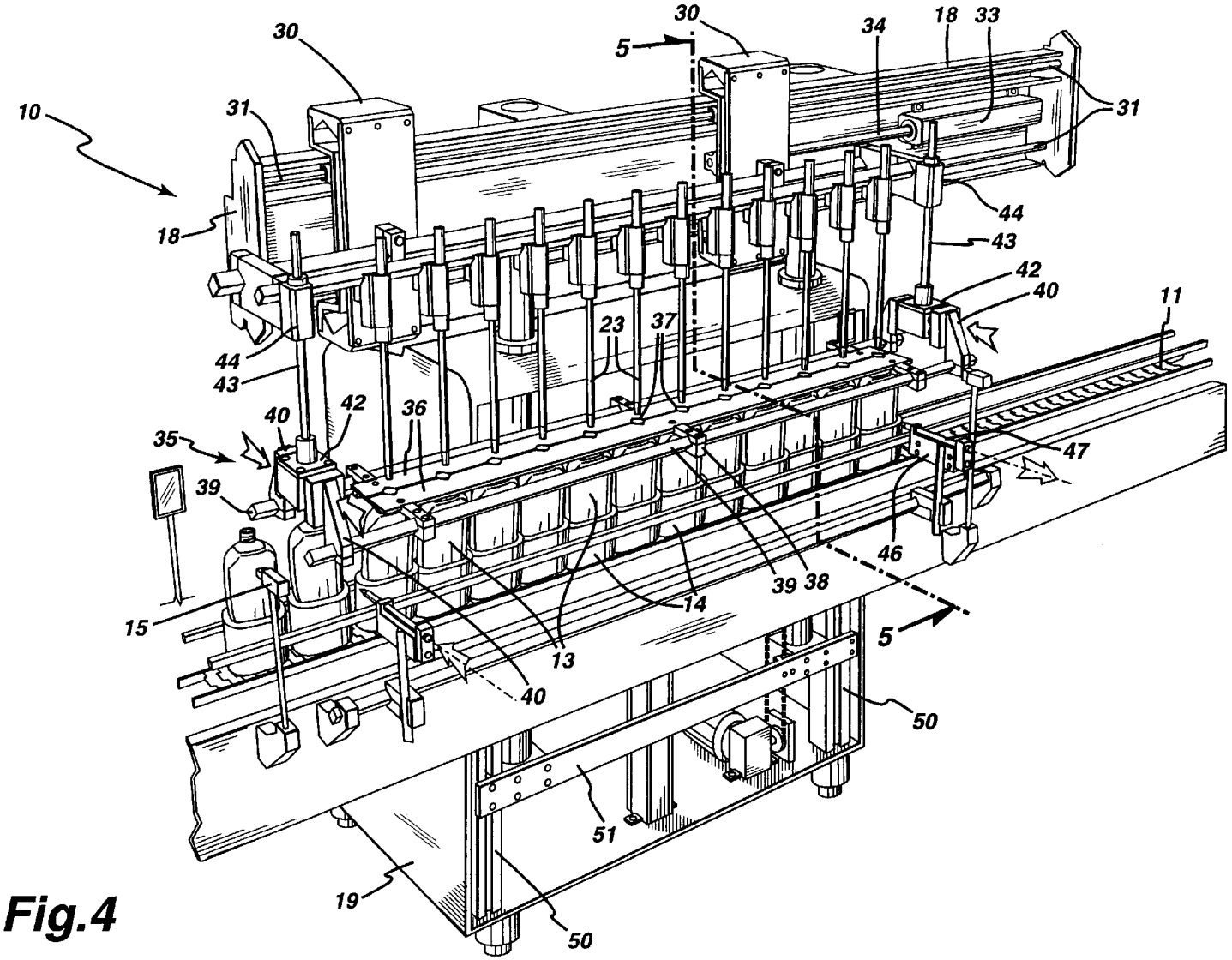
FIG. 4 is a view similar to FIG. 2 showing a later stage.
Figure 6:
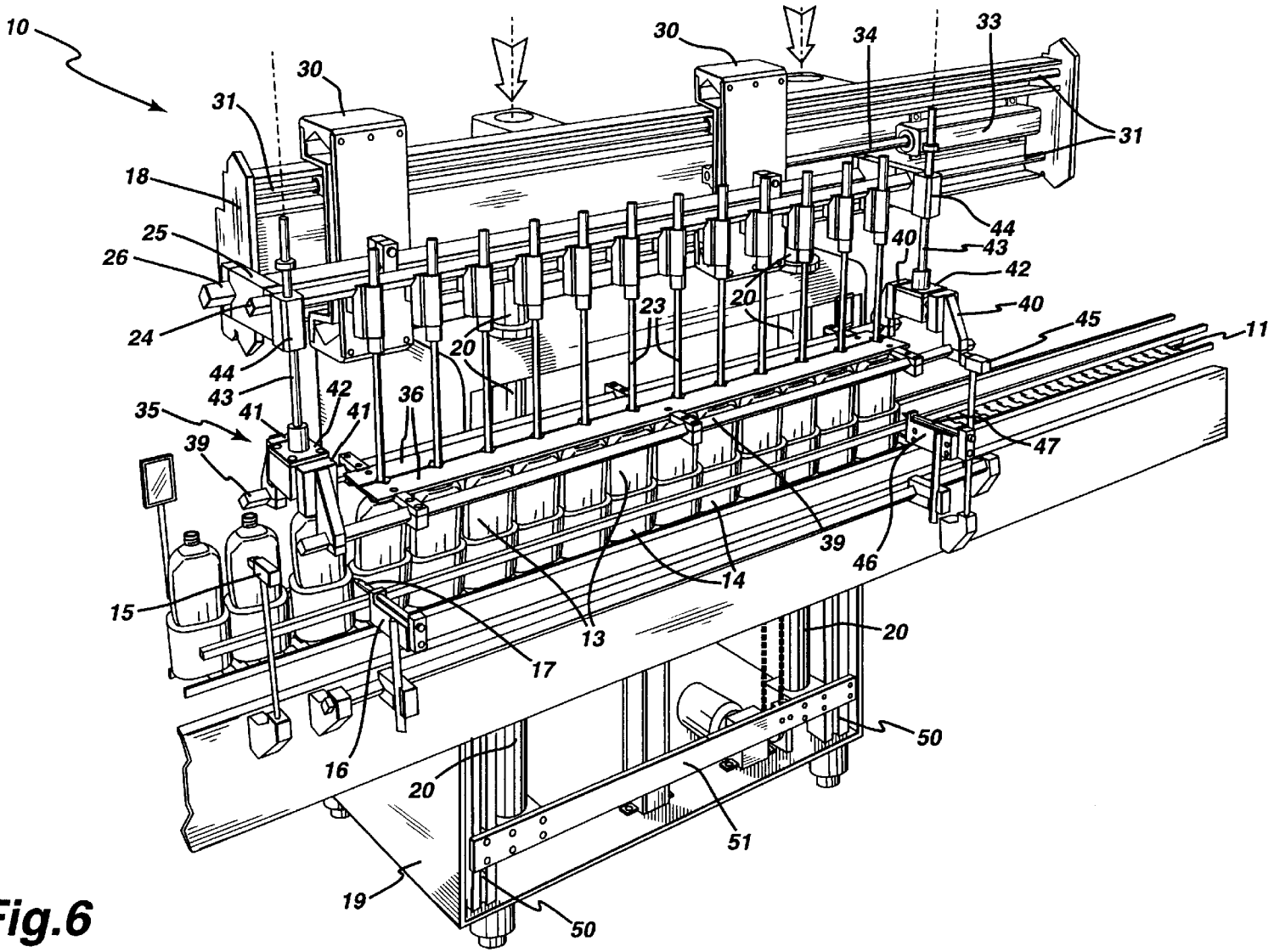
FIG. 6 is a view similar to FIG. 4 showing a later stage.
Figure 7:
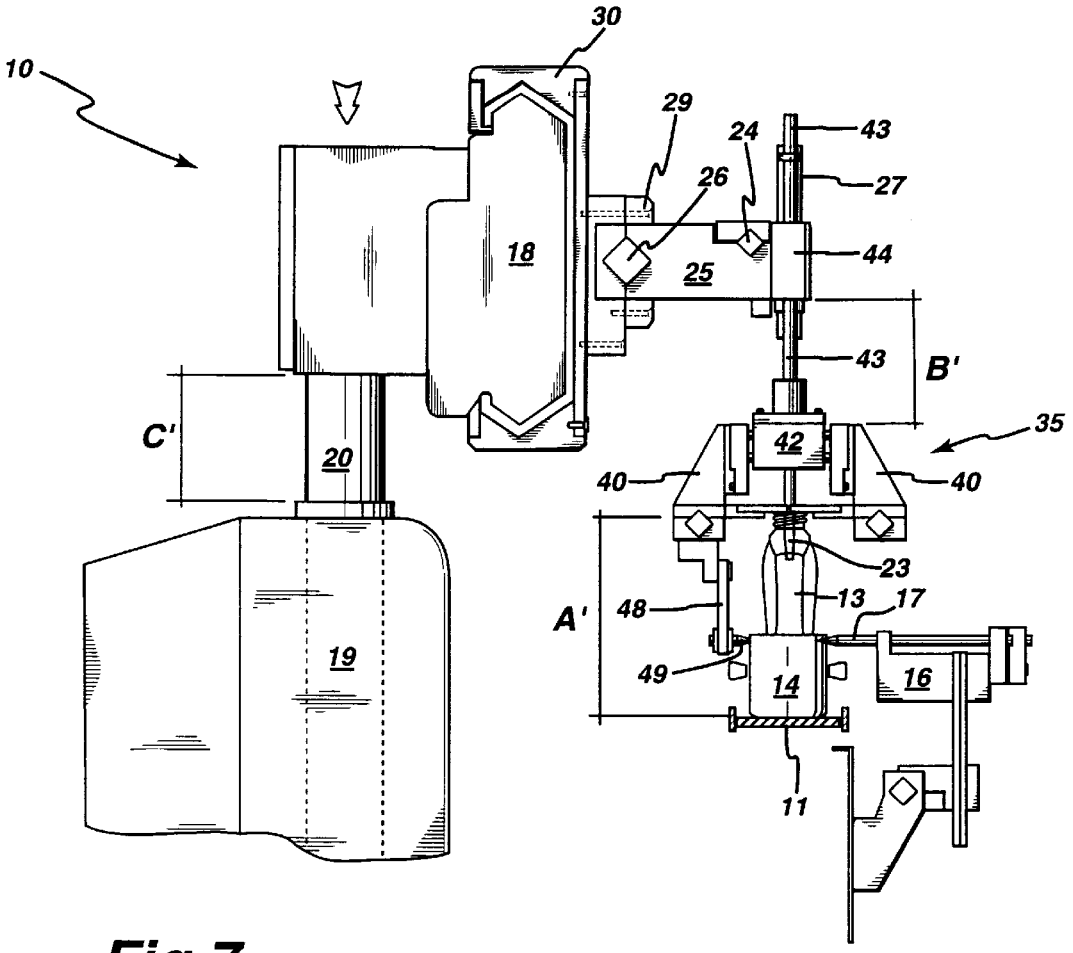
FIG. 7 is an end view of the filling station apparatus as seen in FIG. 6.
Figure 9:
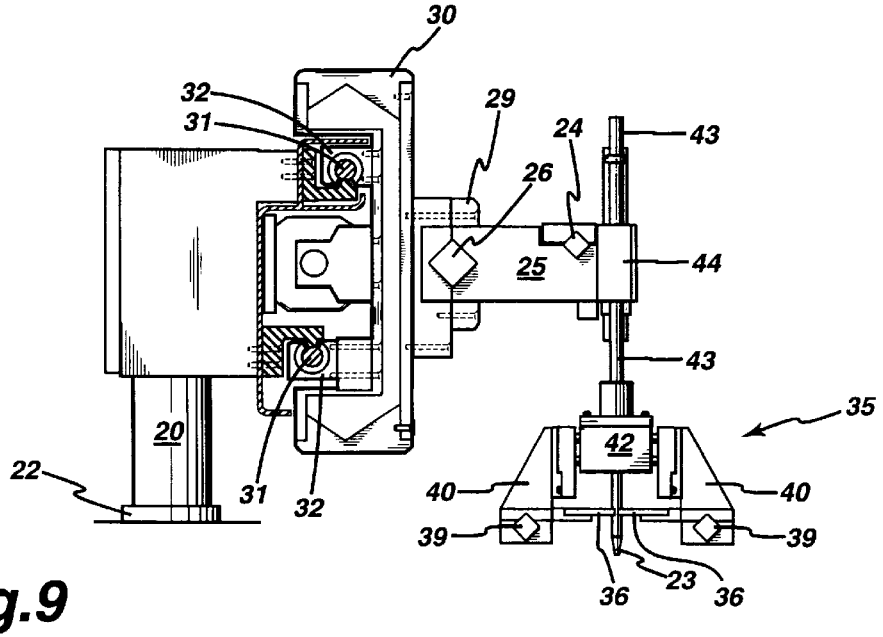
FIG. 9 is a fragmentary sectional view taken on the line 9—9 in FIG. 8.
Figure 8:
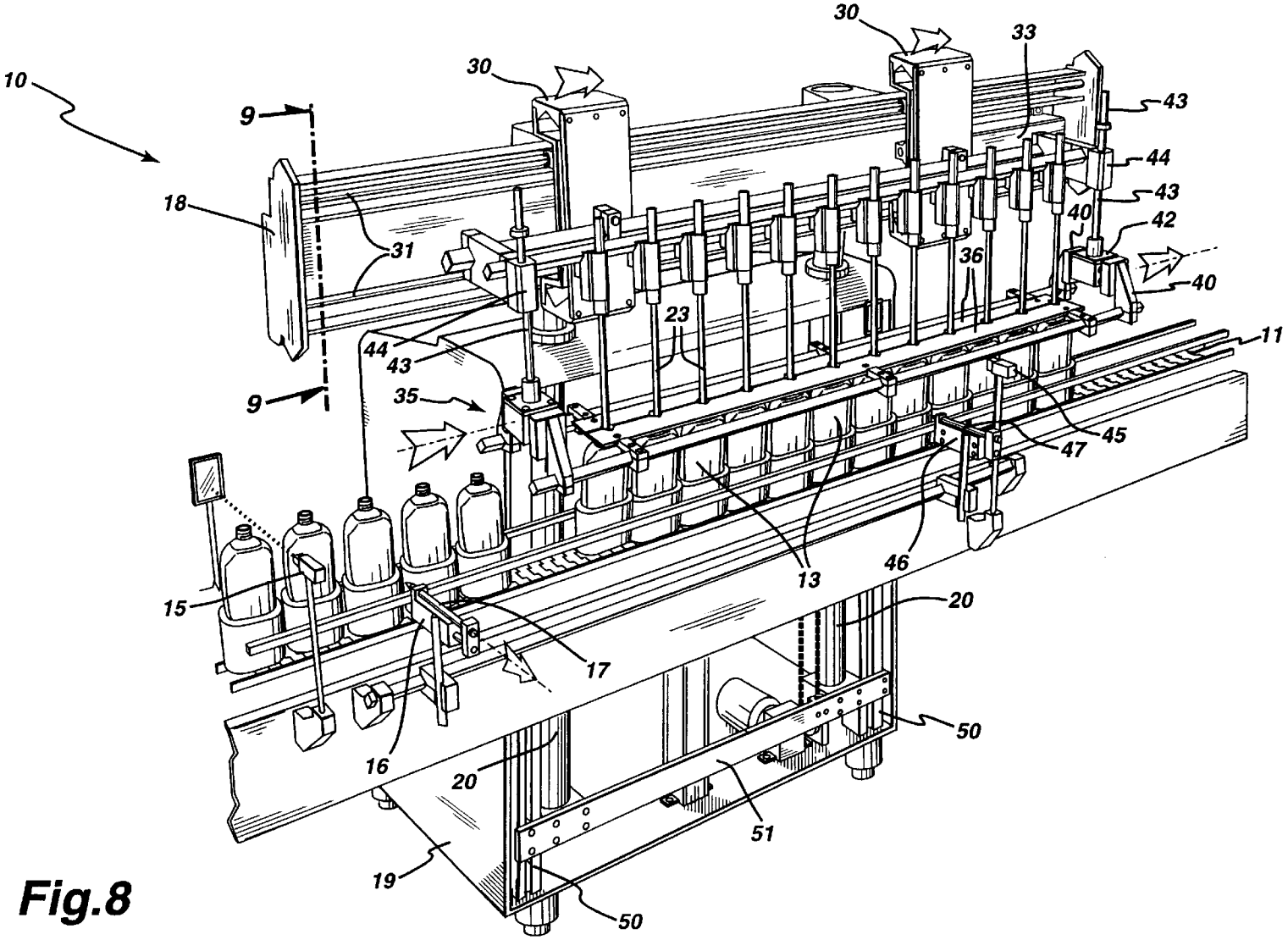
FIG. 8 is a view similar to FIG. 6 showing a later stage.
Figure 10:
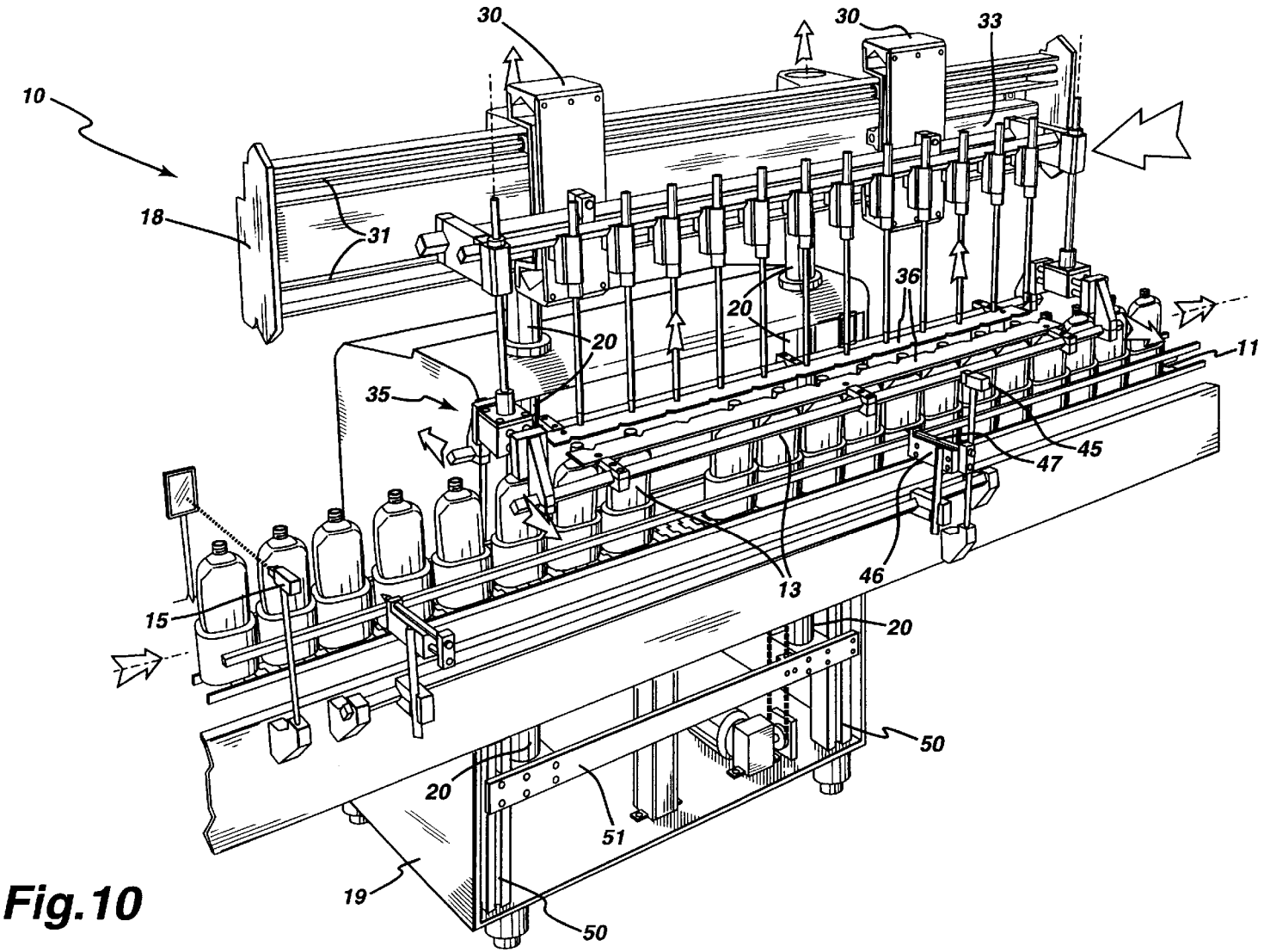
FIG. 10 illustrates a final stage in the operation of the filling station.

First the actuators in the parallel grippers 42 are operated to move the clamp plates 36 towards one another and bring the gripping notches 37 into firm engagement with the necks of the containers as indicated by the heavy black arrows in FIG. 4. In that same motion, the walking gate 48 is brought into the stream of containers and holds the first container of the batch. Once the containers have been gripped and are held by the walking gate, the end gate 46 is opened so that the containers in the filling station can be moved in the downstream direction as urged by frictional contact between the plates 12 of the continuously moving conveyor and the undersides of the cups 14 in which the containers are carried. Simultaneously with opening of the gate 46 the pneumatic cylinder assembly 33 is actuated to initiate retraction of this piston rod 34 from the fully extended position shown in FIG. 6, and thus advancing movement of the gripper system 35 (and the containers 13 held thereby) and the bank of nozzles 23 longitudinally in the downstream direction of the machine. Likewise the bank of tubular nozzles 23 are set in motion to descend in unison into the necks of their respective containers 23 and to begin pumping fluid into the containers. As has been mentioned above, the fluid is supplied from pumps to the nozzles 23 through an arrangement of hoses 28, the hoses being omitted for the sake of clarity in views other than FIG. 1.

The speed of retracting movement of the piston rod 34 is matched to the speed of advance of the conveyor 11 so that the nozzles advance longitudinally at generally the same speed as the containers 13 without interference. Similarly the filling cycle of the nozzles, i.e. the time during which the nozzles are lowered into the containers, raised as they deliver the fluid product into the containers, and brought upwardly to the retracted position (these motions being controlled by actuation of the motor 21 and of the posts 20) is arranged to take place within the duration of the retraction stroke of the cylinder 34 so that by the time this retraction movement is complete, the group of containers in the filling station have been filled to the desired extent, and the nozzles 23 retracted upwardly to a position where they are clear of the containers. The downstream horizontal travel of the main beam 18 ends when the pumps confirm the filling is completed and when the contact switch (not shown) of the upper position of the nozzles is reached. The main beam 18 stroke varies with the container size, the filling volume, the filling speed and the main beam speed. If the end of the stroke is reached before the end of the fill, the pumping of liquid in the containers will continue with the main beam staying fixed until the proper signals are given to end the cycle. When the nozzles have been retracted, the clamp plates 36 are immediately separated to release the containers. In view of the fact that the end gate 46 is open, the filled containers are carried out of the filling station on the conveyor 11 for further processing, passing a second counter 45 which verifies that all of the batch of containers 13 have left the filling station.

Once the filled containers are clear of the filling station, the end gate 46 is operated to temporarily block exit of any containers from the filling station. As the next batch of containers 13 is being advanced into the filling station, the pneumatic piston 33 is actuated to extend the piston rod and reciprocate the bank of nozzles 23 back to the start position where they are located as shown in FIG. 1. When this position is reached the next filling cycle can commence.

Operation of the different parts of the filling station are performed in a sequence as determined by a machine control system (not shown) the design of which is not discussed herein since it is well understood by those skilled in the art, and indeed may take various forms, and typically will include various timers, switches and actuators that are operated in a desired sequence under the control of a central processor computer.

The invention is not restricted to the precise details of the embodiment discussed above and disclosed in the accompanying drawings, but rather encompasses all embodiments and variations as come within the scope of the following claims.

I claim:

1. A filling apparatus for filling a product into containers, comprising:

a filling station adapted to receive containers coming from a conveyor system and to separate the containers into batches, said filling station capable of simultaneously filling the product into the containers of each batch, and also adapted for discharging batches of filled containers from an exit end of said station for further processing;

wherein said filling station comprises:

a walking nozzle bank having a series of nozzles mounted to move in unison to be inserted into respective ones of the containers of each batch to add product thereto, and to be withdrawn from said containers when filling has been completed;

a transport system for advancing said nozzle bank in a longitudinal direction towards said exit end in synchronized movement with and during filling of the batch of containers; and a gripper mounted for movement in a longitudinal direction in synchronism with said walking nozzle bank, said gripper being selectively operable to engage the containers of each batch received into said filling station, to securely hold the batch of containers during nozzle insertion, filling and nozzle retraction, and after filling has been completed to release the batch of containers for discharge from said exit end.

2. The apparatus of claim 1 wherein said gripper comprises a pair of opposed jaws each extending in said longitudinal direction, said jaws being configured with rows of registering recesses in opposed pairs, each said pair adapted to engage and securely grip a respective container of the batch, and a power actuator selectively operable to effect movement of said jaws in a direction transverse to said longitudinal direction from a retracted release position to an advanced container-gripping position.

3. The apparatus of claim 2 adapted for use with containers having a variety of neck sizes and shapes, said jaws being configured to grip the necks of the containers and also being interchangeable to accommodate different neck sizes and shapes.

4. The apparatus of claim 1 wherein further comprising a transport arrangement cooperating with a section of said conveyor system that passes through said filling station and beyond the exit end thereof, said apparatus including a gate selectively operable to prevent transfer of containers from said conveyor system into said filling station and to permit entry of a predetermined number of containers constituting a batch; a blocker selectively operable to prevent movement of containers through said exit end, wherein the containers stand upon said conveyor system and wherein said conveyor system is operated continuously and is adapted to slide under any container that is immobilized or retarded by said gate or said blocker.

5. The apparatus of claim 4 in combination with a series of wide based cups each adapted to receive and support a respective container, said cups being useful for processing containers of a shape that would render them unsuitable for supports directly on said conveyor system.

6. The apparatus of claim 4 wherein said transport arrangement further comprises the section of said conveyor system that passes through said filling station and beyond the exit end thereof.

7. The apparatus of claim 4 wherein said transport arrangement further comprises a walking gate that works in unison with said gripper, said walking gate holding the mid-section of the first container of a batch as said nozzle bank advance.

8. The apparatus of claim 4 wherein said transport arrangement further comprises an optical counter to count containers entering said filling station and an optical counter to count containers exiting said filling station.

9. The apparatus of claim 1 wherein said nozzle bank is supported on a beam that is mounted for reciprocating movement in a vertical direction, said nozzle bank being further supported on said beam for reciprocating movement in the longitudinal direction; said gripper being carried on said beam and mounted for reciprocating movement in a direction transverse to said longitudinal direction.

10. The apparatus of claim 1 wherein said product is a substantially fluid product.

11. The apparatus of claim 1 wherein said product is a powdery product.

12. The apparatus of claim 1 wherein the distance between each said nozzle of the nozzle bank is adjustable to accommodate containers of different shapes and sizes.

* * * * *